US006593256B1

(12) United States Patent
Wildeman

(10) Patent No.: US 6,593,256 B1
(45) Date of Patent: Jul. 15, 2003

(54) FLUID CONTAINMENT TEXTILE AND INCONTINENCE PAD FORMED THEREFROM

(75) Inventor: Martin Wildeman, Spartanburg, SC (US)

(73) Assignee: TieTex International, Ltd, Spartanburg, SC (US)

( * ) Notice: Subject to any disclaimer, the term of this patent is extended or adjusted under 35 U.S.C. 154(b) by 0 days.

(21) Appl. No.: 09/537,324

(22) Filed: Mar. 29, 2000

(51) Int. Cl.[7] ..... D04H 1/46; D04H 3/10; D04H 5/02

(52) U.S. Cl. ..... 442/402; 442/327; 442/381; 442/389; 442/394; 442/395; 442/414

(58) Field of Search ..... 442/327, 381, 442/389, 394–395, 402, 414

(56) References Cited

U.S. PATENT DOCUMENTS

| | | | | | |
|---|---|---|---|---|---|
| 1,816,416 | A | | 7/1931 | Willingham | |
| 2,580,089 | A | | 12/1951 | Grant | 66/85 |
| 2,672,673 | A | | 3/1954 | Shaw | 28/4 |
| 3,642,561 | A | * | 2/1972 | Grobner | 428/102 |
| 3,717,150 | A | * | 2/1973 | Schwartz | 428/81 |
| 4,026,129 | A | | 5/1977 | Sternlieb | 66/192 |
| 4,128,686 | A | | 12/1978 | Kyle et al. | 428/219 |
| 4,144,612 | A | | 3/1979 | Yamaguchi | 15/208 |
| 4,516,975 | A | | 5/1985 | Mitchell | 604/385 |
| 4,664,959 | A | | 5/1987 | Dagenais et al. | 428/74 |
| 4,675,226 | A | | 6/1987 | Ott | 428/102 |
| 4,723,954 | A | | 2/1988 | Pieniak | 604/384 |
| 4,811,573 | A | | 3/1989 | Sternlieb | 66/193 |
| 4,876,128 | A | | 10/1989 | Zafiroglu | 428/102 |
| 4,879,169 | A | | 11/1989 | Zafiroglu | 428/230 |
| 4,943,286 | A | | 7/1990 | Armstead | 604/558 |
| 4,961,982 | A | | 10/1990 | Taylor | 428/41 |
| 5,062,418 | A | | 11/1991 | Dyer et al. | 128/156 |
| 5,149,332 | A | | 9/1992 | Walton et al. | 604/358 |
| 5,192,600 | A | * | 3/1993 | Pontrelli et al. | 112/402 |
| 5,203,186 | A | * | 4/1993 | Zafiroglu | 112/438 |
| 5,267,991 | A | | 12/1993 | Gillies et al. | 604/375 |
| 5,296,290 | A | | 3/1994 | Brassington | 428/300 |
| 5,306,267 | A | | 4/1994 | Hahn et al. | 604/378 |
| 5,308,673 | A | | 5/1994 | Tochacek et al. | 428/102 |
| 5,308,674 | A | | 5/1994 | Zafiroglu | 428/102 |
| 5,330,817 | A | | 7/1994 | Arnott et al. | 428/85 |
| 5,350,625 | A | | 9/1994 | Peterson et al. | 428/219 |
| 5,356,402 | A | | 10/1994 | Gillies et al. | 604/375 |
| 5,365,677 | A | | 11/1994 | Dalhgren | 36/3 |
| 5,433,987 | A | | 7/1995 | Peterson et al. | 428/137 |
| 5,486,167 | A | | 1/1996 | Dragoo et al. | 604/384 |
| 5,556,392 | A | | 9/1996 | Koczab | 604/378 |
| 5,562,648 | A | * | 10/1996 | Peterson | 604/370 |

(List continued on next page.)

FOREIGN PATENT DOCUMENTS

| | | |
|---|---|---|
| EP | 429802 | 6/1991 |
| EP | 496567 | 7/1992 |
| EP | 261904 | 3/1998 |

*Primary Examiner*—Terrel Morris
*Assistant Examiner*—Norca L. Torres
(74) *Attorney, Agent, or Firm*—J. M. Robertson Intellectual Prop. L.L.C.

(57) ABSTRACT

A launderable fluid containment textile composite of stitch bonded construction useful in an incontinence pad. The textile composite includes a fluid retention layer of non-woven fabric formed from a plurality of intermingled textile fibers. A liquid permeable barrier layer of porous fabric is disposed across the fluid retention layer. A plurality of spun yarns including polyester and rayon constituents extend in a repeating stitch bonding pattern through the fluid retention layer and the liquid permeable barrier layer such that the spun yarns form a surface layer over the liquid permeable barrier layer at the technical face of the textile composite. The stitch bonding pattern is characterized by a stitch density in the machine direction of about 4 to about 14 stitches per inch.

47 Claims, 1 Drawing Sheet

U.S. PATENT DOCUMENTS

| | | | | |
|---|---|---|---|---|
| 5,652,041 | A | 7/1997 | Buerger et al. | 428/198 |
| 5,681,300 | A | 10/1997 | Ahr et al. | 604/367 |
| 5,685,247 | A | 11/1997 | Hosselbarth | 112/440 |
| 5,759,662 | A | 6/1998 | Heiman | 428/85 |
| 5,879,487 | A | 3/1999 | Ravella | 156/62.8 |
| 5,902,757 | A | 5/1999 | Stern et al. | 442/324 |
| 5,925,581 | A | 7/1999 | Tolbert | 442/334 |
| 5,948,711 | A | 9/1999 | Closson | 442/398 |
| 6,030,908 | A | 2/2000 | Baker et al. | 442/402 |
| 6,277,469 | B1 | 8/2001 | Wildeman | 428/167 |

* cited by examiner

FLUID CONTAINMENT TEXTILE AND INCONTINENCE PAD FORMED THEREFROM

TECHNICAL FIELD

The present invention is directed generally to a textile composite of stitch bonded construction and more particularly to a textile composite of dimensionally stable stitch bonded construction useful in a reusable absorbent pad structure which must withstand multiple laundering operations.

BACKGROUND OF THE INVENTION

It is generally known to utilize a reusable absorbent pad referred to as an incontinence pad as part of the bedding of persons having an inability to control the discharge of bodily fluids. The purpose of such pads is to draw urine or other fluid as may be discharged away from the person thereby relieving the discomfort which may arise from extended contact with such fluids. Such pads typically incorporate one or more layers of felt material within the interior of the pad to draw the fluids away from the surface and to hold such fluids in place until the pad may be laundered. Through such absorption and retention by the fluid retaining layer, the surface of the pad is maintained in a relatively dry state. A fluid impermeable backing is typically disposed beneath the felt to prevent leakage of the retained fluid onto the underlying bed linens.

Historically, incontinence pads have been manufactured according to a substantially stepwise procedure wherein the fabric forming the user contact surface is formed separately from the material forming the fluid retention layer and a quilting process is thereafter applied to hold those layers together. Such a manufacturing process has been found to be potentially cost prohibitive.

SUMMARY OF THE INVENTION

The present invention provides alternatives and advantages over the prior art by providing a launderable fluid containment textile composite suitable for use in an incontinence pad wherein the outer surface layer of the composite which contacts the user is formed over the interior layers during the assembly of the composite. This formation is effected through the use of a highly efficient stitch bonding procedure which simultaneously stabilizes the composite and forms the user contact surface.

The user contact surface which is made up of the cooperating stitch elements applied during the stitch bonding operation serves to cover the underlying interior components of the composite and provides the desired soft feel which is generally desired for use in a bedding environment. The pattern utilized for application of the stitches forming the user contact surface is such that the desired level of surface coverage may be obtained while nonetheless operating the stitch application equipment at an extremely high throughput rate such that the stitch bonding equipment may be operated at extremely high efficiency.

The stitch bonded composite formed according to the present invention may be utilized as a component of an incontinence pad or in such other applications wherein the resultant characteristics of dimensional stability and high absorption may prove to be beneficial.

Accordingly, it is a feature of the present invention to provide a fluid containment textile composite of stitch bonded construction.

It is an additional feature of the present invention to provide a fluid containment textile composite of stitch bonded construction having sufficient internal dimensional stability to withstand multiple laundering operations.

It is a further feature of the present invention to provide a launderable fluid containment textile composite of stitch bonded construction which may include a fluid retention layer of non-woven fabric, a liquid permeable barrier layer extending across the fluid retention layer and a user contact surface formed from a plurality of yarns extending in a repeating stitch bonding pattern through the fluid retention layer and liquid permeable barrier layer.

According to a further feature of the present invention, the stitch bonding yarns forming the user contact surface may be spun yarns including polyester and rayon or other cellulosic fiber constituents.

According to an additional feature of the present invention, the stitch bonding yarns forming the user contact surface of the textile composite according to the present invention may be applied through the layers of material forming the composite according to a repeating stitch configuration such that the stitch bonding pattern is characterized by a low stitch density which may be in the range of about 14 stitches per inch or less in the machine direction of the formed composite while nonetheless providing substantial surface coverage.

According to one aspect of the present invention, a launderable fluid containment textile composite of stitch bonded construction is provided. The textile composite includes a fluid retention layer of non-woven fabric formed from a plurality of intermingled textile fibers. A liquid permeable barrier layer of spun bonded fabric is disposed across the fluid retention layer. A plurality of spun yarns including polyester and rayon constituents extend in a repeating stitch bonded pattern through the fluid retention layer and the liquid permeable barrier layer such that the spun yarns form a surface layer over the liquid permeable barrier layer at the technical face of the textile composite. The stitch bonding pattern is characterized by a stitch density in the machine direction of about 4 to about 14 stitches per inch.

BRIEF DESCRIPTION OF THE DRAWINGS

The principles of the present invention are set forth in the following detailed description through reference to the accompanying drawings which are incorporated in and constitute a part of this specification in which.

While the invention has been illustrated and generally described above, and will hereafter be described in detail in connection with certain potentially preferred embodiments, it is to be appreciated that the foregoing general description as well as the particularly illustrated and described embodiments as may be set forth herein are exemplary only. Accordingly, there is no intention to limit the invention to such particularly illustrated and described embodiments. On the contrary, it is intended that the present invention shall extend to all alternatives, modifications, and equivalents as may embody the broad aspects of the invention within the full spirit and scope thereof.

DESCRIPTION OF THE PREFERRED EMBODIMENT

Figure 1:
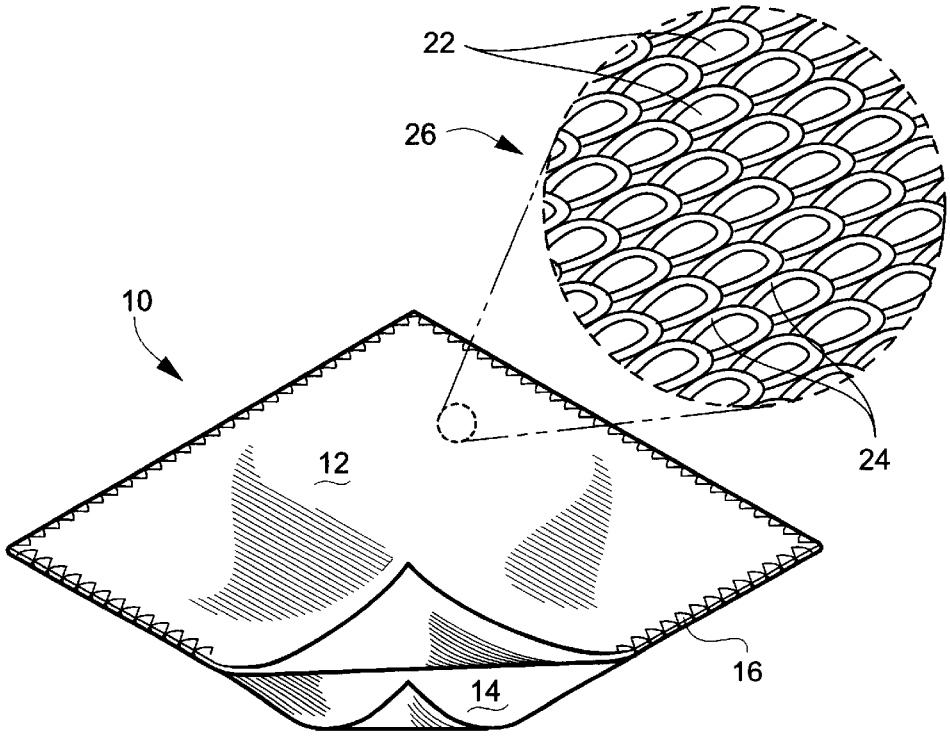
FIG. 1 illustrates an incontinence pad as may incorporate the fluid containment textile composite according to the present invention including an enlarged view of the user contact surface of such fluid containment textile composite.

In general, the present invention is directed to an improved construction for a fluid containment textile composite. In FIG. 1, there is illustrated an incontinence pad 10 such as may be used to collect and retain discharges of urine, blood, or other bodily fluids as may be released from time to time. By way of example only, such an incontinence pad 10 may find application in the bedding or wheelchairs of hospital patients who experience intermittent loss of bladder control, thereby resulting in uncontrollable discharges of urine. In such an environment, the incontinence pad 10 serves the function of collecting and retaining the discharged fluid so as to prevent extended contact between such fluid and the patient.

As illustrated, the incontinence pad 10 includes a textile composite portion 12 which may be joined to an underlying fluid barrier layer 14 by seam stitching 16 or other appropriate bonding mechanisms such as adhesives or ultrasonic bonding techniques as may be known to those of skill in the art. The barrier layer 14 may be any suitable liquid impermeable material including, by way of illustration only, vinyl, plastic or a coated or laminated textile structure as will be well known to those of skill in the art to which the present invention pertains.

Figure 2:
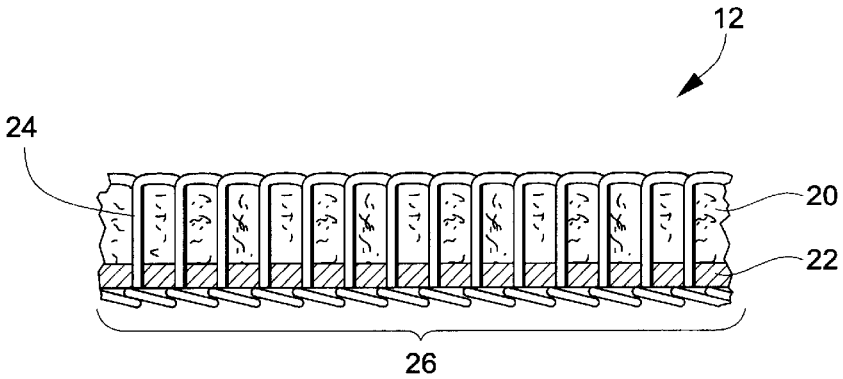
FIG. 2 is a cross-sectional view of a potentially preferred embodiment of the fluid containment textile composite according to the present invention.

The textile composite portion 12 of the incontinence pad 10 is preferably a stitch bonded composite in accordance with the present invention which has a configuration generally as illustrated in FIG. 2. As illustrated therein, the textile composite 12 formed in accordance with the present invention preferably includes a fluid retention layer 20 disposed across a liquid permeable barrier layer 22 and a plurality of bonding yarns 24 running through the fluid retention layer 20 and liquid permeable barrier layer 22 so as to form a dimensionally stable composite structure.

The segments of the bonding yarns 24 which extend outwardly from the liquid permeable barrier layer 22 serve to cooperatively define a user contact surface 26 across the technical face of the textile composite 12 in a manner to be described further hereinafter. According to the illustrated and potentially preferred embodiment, segments of the bonding yarns 24 will likewise extend through the outer surface of the fluid retention layer 20 at the technical back of the textile composite 12 thereby serving to define the underside of the textile composite 12 to which the liquid impermeable barrier layer 14 is applied. As will be discussed further hereinafter, the stitch configuration and concentration of bonding yarns 24 forming the user contact surface 26 is sufficient to substantially cover the surface of the textile composite 12.

In order for the textile composite 12 to effectively withdraw and retain fluids away from the user, the fluid retention layer 20 is preferably formed at least in part from a highly absorbent material. In the potentially preferred form of the invention, the material forming the fluid retention layer 20 is a non-woven batt of blended fibers including both hydrophobic and hydrophilic constituents. The blend of material preferably includes about 10% to about 80% polyester fiber in combination with about 90% to about 20% rayon fiber. One potentially preferred blend of material includes about 80% polyester fiber in combination with about 20% rayon fiber.

As will be appreciated, the rayon constituent fibers are of a highly hydrophilic character thereby tending to attract fluid. The polyester constituent fibers which surround the rayon fibers are of a highly hydrophobic character and serve to contain the fluid. According to the potentially preferred embodiment of the present invention, both the hydrophobic and the hydrophilic fibers will be of substantially equivalent average denier and will be dispersed substantially uniformly throughout the fluid retention layer 20 such that the absorptive properties of the fluid retention layer will be substantially uniform across the thickness of the fluid retention layer 20. The average denier of the fibers making up the fluid retention layer 20 is preferably in the range of about 3 denier to about 6 denier and is most preferably in the range of about 4 denier.

In the event that additional stability is desired within the fluid retention layer 20, it is contemplated that some percentage of low melt bicomponent fiber such as KOSA™ type 252 may also be included within the blend. The inclusion of such a low melt fiber permits the batt to undergo a heat fusion process wherein the temperature of the formed batt is raised to a level above the melting point of the low melt fiber thereby permitting the low melt fiber to undergo at least a partial melting so as to bind the fibers of the batt together when the temperature is reduced.

Due to the fibrous nature of the material forming the fluid retention layer 20, in the potentially preferred form of the invention the liquid permeable barrier layer 22 is utilized as a veil to prevent the outward migration of the fibers forming the fluid retention layer 20 towards the user contact surface 26. While the inclusion of such a liquid permeable barrier layer 22 may be preferred, it is likewise contemplated that such barrier layer 22 may be eliminated if desired. However, in the event that such a liquid permeable barrier layer 22 is utilized, fluid must be capable of passing across such barrier layer 22 without substantial interference in order to avoid any undesirable pooling of such fluids at the user contact surface 26.

In the potentially preferred embodiment of the present invention, the material forming the liquid permeable barrier layer 22 is a spun bonded polyester fabric having a weight of about 30 grams per square meter. Such material is characterized by relatively fine interstitial voids such that the barrier layer 22 is capable of providing adequate cover to prevent the migration of fibers away from the fluid retention layer 20 outwardly to the user contact surface 26. At the same time, the porosity of the barrier layer 22 is sufficient to permit the substantially unimpeded flow of fluid away from the user contact surface 26 during use. In order to maintain the liquid permeable barrier layer 22 in a substantially dry condition, the material forming such layer is preferably of a substantially hydrophobic character. By way of example only, and not limitation, one material which is believed to be suitable is polyester.

In order to promote user comfort, the user contact surface 26 is preferably of a nature such that substantial amounts of fluid will not be absorbed and retained thereat. Thus, it is contemplated that the bonding yarns 24 which cooperate to form the user contact surface 26 are preferably of a substantially hydrophobic character. However, notwithstanding the desire to maintain the user contact surface 26 in a substantially dry state, it is also desired that such user contact surface 26 be substantially nonabrasive when touched by the user. Surprisingly, it has been found that the use of bonding yarns 24 of a spun construction which incorporate hydrophobic synthetic polymer fibers as the primary constituent in combination with cellulosic fibers as a secondary constituent imparts a soft, nonabrasive tactile character to the user contact surface while nonetheless avoiding substantial retention of fluid at the user contact surface 26 despite the substantially hydrophilic character of such cellulosic fiber.

One such spun yarn which may be particularly preferred is spun yarn incorporating about 80% polyester and about 20% rayon. Of course, it is to be appreciated that a greater or lesser percentage of rayon or other cellulosic constituent may be incorporated into the bonding yarns 24 as may be desired. By way of example only, it is contemplated that the bonding yarns 24 may include as much as about 40% or more of rayon without negatively affecting the performance of the user contact surface 26. It is likewise contemplated that the rayon or other cellulosic constituent may be eliminated entirely if desired. In such a configuration, the spun character of the bonding yarns 24 nonetheless provides the desired tactile character. The use of such all polyester bonding yarns 24 may impart a brilliant white character to the user contact surface 26 which may be desirable in some applications.

As will be appreciated, the user contact surface 26 which is formed by the cooperating stitches of the bonding yarns 24 preferably provides substantial coverage over the liquid permeable barrier layer 22. According to the illustrated and potentially preferred embodiment of the present invention, such coverage is achieved by the cooperative stitch bonding relation of the bonding yarns 24. According to a potentially preferred practice, the bonding yarns 24 are repeatedly passed through the fluid retention layer 20 and the liquid permeable barrier layer 22 in a repeating stitch configuration using a LIBA™ type stitch bonding machine although Malipol or other stitch bonding equipment as may be known to those of skill in the art may also be utilized. A single bar stitch system is potentially preferred, although it is contemplated that stitch systems incorporating two or more bars may also be incorporated.

Figure 3:
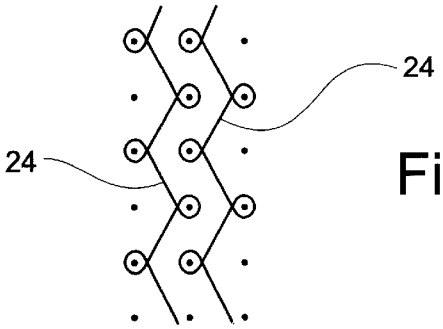
FIG. 3 is a point diagram of a potentially preferred stitch bonding pattern as may be utilized in the construction of the fluid containment textile composite according to the present invention.

One potentially preferred arrangement of the stitches formed by the bonding yarns 24 is a tricot stitch configuration as illustrated in the point diagram of FIG. 3 having a stitch notation of 1,0/0,2. According to the potentially preferred practice, the stitches are passed over a pile sinker so as to permit the bonding yarns 24 to appear relaxed in the final construction.

The stitches formed by the bonding yarns 24 are preferably applied in the cross machine direction according to about an 8 gauge to about a 20 gauge construction and will most preferably be applied according to about a 14 gauge construction, although it is contemplated that greater or lesser constructions may be utilized as desired. The stitch density in the machine direction is preferably in the range of about 4 stitches per inch to about 20 stitches per inch, and more preferably will be in the range of about 8 stitches per inch to about 14 stitches per inch, and will most preferably be in the range of about 8 stitches per inch.

As indicated previously, the bonding yarns 24 are preferably of a spun configuration. According to the potentially preferred embodiment of the present invention such spun yarns will be of a singles configuration characterized by a cotton count of about 6 to 36 and will most preferably be an 8 singles spun yarn. Although a spun construction is potentially preferred for the bonding yarns 24, it is also contemplated that yarns of differing constructions may be utilized. By way of example only, one such alternative yarn as may be utilized is a textured polyester yarn. Such textured polyester will preferably be characterized by a linear density of about 200 to about 400 denier and will most preferably have a linear density of about 300 denier. It is further contemplated that the bonding yarns 24 may be treated with an antimicrobial agent as may be known to those of skill in the art so as to further promote the sanitary character of the composite 12.

As indicated, in the preferred embodiment of the invention the user contact surface 26 is formed across the technical face of the textile compositely. It has been found that the application of the described stitch construction across the textile composite 12 yields an arrangement of cooperating stitch elements across the technical face substantially as illustrated in FIG. 1. As will be appreciated, while the voids surrounding the yarn segments forming the individual stitch elements have been greatly enhanced for illustrative purposes, in actual practice the stitch elements formed by the individual bonding yarns 24 serve to provide substantial coverage over the liquid permeable barrier layer 22 or such other layer as may be disposed beneath the user contact surface 26. Surprisingly, it has been found that such coverage may be achieved even at relatively low stitch densities in the machine direction. Moreover, according to the potentially preferred form of the present invention wherein the bonding yarns are of a spun construction, surface coverage is enhanced still further by the fullness of such spun yarns.

In accordance with the above description, it may be seen that the present invention provides a useful and highly efficient textile composite 12 and incontinent pad 10 formed therefrom. The textile composite 12 includes a user contact surface 26 formed from a plurality of stitch bonding yarns 24 which serve to provide substantial coverage to underlying layers without depending upon the utilization of high stitch densities to effect such coverage. The utilization of low stitch densities in the machine direction of the stitch bonded composite 12 permits the efficient application of bonding yarns 24 at high rates of throughput. The tactile character and surface coverage of the user contact surface may be further enhanced through the use of bonding yarns 24 of spun construction. Such spun yarns may include both hydrophobic and hydrophilic fiber constituents.

While the present invention has been illustrated and described in relation to particularly preferred embodiments and constructions, it is to be understood that such embodiments and constructions are illustrative only and the present invention is in no event to be limited thereto. Rather, it is contemplated that modifications and variations to the present invention will no doubt occur to those of skill in the art upon reading the above description and/or through practice of the invention. It is therefore contemplated and intended that the present invention shall extend to all such modifications and variations which incorporate the broad aspects of the present invention within the full spirit and scope thereof.

What is claimed is:

1. A launderable fluid containment textile composite of stitch bonded construction useful in absorbing fluid discharged by a user, the textile composite comprising:

a fluid retention layer of non-woven batting; and a plurality of bonding yarns extending in a repeating stitch bonding pattern through said fluid retention layer at an as stitched stitch density in the machine direction of not greater than about 14 stitches per inch wherein segments of said bonding yarns extending outwardly from said fluid retention layer define a covering surface for contact by the user, and wherein said fluid retention layer comprises a blended mixture of hydrophobic and hydrophilic constituent fibers, and wherein said blended mixture comprises about 20% or greater hydrophobic constituent fibers in blended relation with a percentage of hydrophilic constituent fibers, and wherein the covering surface for contact by the user is substantially nonabrasive in character such that a comfort level suitable for intimate contact by a user is provided.

2. The invention according to claim 1, wherein said bonding yarns are of a spun construction.

3. The invention according to claim 2, wherein said bonding yarns comprise hydrophobic constituent fibers and hydrophilic constituent fibers.

4. The invention according to claim 2, wherein said bonding yarns comprise polyester fibers and rayon fibers.

5. The invention according to claim 2, wherein said bonding yarns consist essentially of about 80% polyester and about 20% rayon.

6. The invention according to claim 2, wherein said bonding yarns consist essentially of about 100% polyester.

7. The invention according to claim 2, wherein said bonding yarns are of a singles spun construction characterized by a cotton count in the range of about 6 to about 14.

8. The invention according to claim 1, wherein said bonding yarns are textured polyester yarns.

9. The invention according to claim 1, wherein said bonding yarns extend through said fluid retention layer at an as stitched stitch density in the machine direction of about 4 to about 14 stitches per inch.

10. The invention according to claim 1, wherein said bonding yarns extend through said fluid retention layer at an as stitched stitch density in the machine direction of about 6 to about 10 stitches per inch.

11. The invention according to claim 1, wherein said bonding yarns extend through said fluid retention layer at an as stitched stitch density in the machine direction of about 8 stitches per inch.

12. A launderable fluid containment textile composite of stitch bonded construction useful in absorbing fluid discharged by a user, the textile composite comprising:

a fluid retention layer of non-woven batting;

a liquid permeable barrier layer disposed in covering relation to said fluid retention layer; and a plurality of bonding yarns extending in a repeating stitch bonding pattern through said fluid retention layer and said liquid permeable barrier layer at an as stitched stitch density in the machine direction of not greater than about 14 stitches per inch wherein segments of said bonding yarns extending outwardly from said liquid permeable barrier layer define a covering surface for contact by the user, and wherein said fluid retention layer comprises a blended mixture of hydrophobic and hydrophilic constituent fibers, and wherein said blended mixture comprises about 20% or greater hydrophobic constituent fibers in blended relation with a percentage of hydrophilic constituent fibers, and wherein the covering surface for contact by the user is substantially nonabrasive in character such that a comfort level suitable for intimate contact by a user is provided.

13. The invention according to claim 12, wherein said bonding yarns are of a spun construction.

14. The invention according to claim 13, wherein said liquid permeable barrier layer comprises a porous polyester fabric.

15. The invention according to claim 14, wherein said bonding yarns comprise hydrophobic constituent fibers and hydrophilic constituent fibers.

16. The invention according to claim 15, wherein said hydrophobic constituent fibers are polyester and said hydrophilic constituent fibers are rayon.

17. The invention according to claim 12, wherein said bonding yarns are textured polyester yarns.

18. The invention according to claim 12, wherein said bonding yarns are of a spun construction and extend through said fluid retention layer and said liquid permeable barrier layer at an as stitched stitch density in the machine direction of about 4 to about 14 stitches per inch.

19. The invention according to claim 12, wherein said bonding yarns are of a spun construction and extend through said fluid retention layer and said liquid permeable barrier layer at an as stitched stitch density in the machine direction of about 6 to about 10 stitches per inch.

20. A launderable incontinence pad including a fluid containment textile composite of stitch bonded construction useful in absorbing fluid discharged by a user, the textile composite comprising:

a fluid retention layer of non-woven batting; and a plurality of bonding yarns of spun construction extending in a repeating stitch bonding pattern through said fluid retention layer at an as stitched stitch density in the machine direction in the range of about 4 to about 12 stitches per inch wherein segments of said bonding yarns extending outwardly from said fluid retention layer define a covering surface for contact by the user, and wherein said fluid retention layer comprises a blended mixture of hydrophobic and hydrophilic constituent fibers, and wherein said blended mixture comprises about 20% or greater hydrophobic constituent fibers in blended relation with a percentage of hydrophilic constituent fibers, and wherein the covering surface for contact by the user is substantially nonabrasive in character such that a comfort level suitable for intimate contact by a user is provided.

21. The invention according to claim 1, wherein at last a portion of said hydrophobic constituent fibers are polyester fibers.

22. The invention according to claim 21, wherein at least a portion of said hydrophilic constituent fibers are rayon fibers.

23. The invention according to claim 12, wherein at least a portion of said hydrophobic constituent fibers are polyester fibers.

24. The invention according to claim 23, wherein at least a portion of said hydrophilic constituent fibers are rayon fibers.

25. The invention according to claim 20, wherein at least a portion of said hydrophobic constituent fibers are polyester fibers.

26. The invention according to claim 25, wherein at least a portion of said hydrophilic constituent fibers are rayon fibers.

27. The invention according to claim 1, wherein said blended mixture of hydrophobic and hydrophilic constituent fibers comprises about 40% or more hydrophobic constituent fibers.

28. The invention according to claim 27, wherein at least a portion of said hydrophobic constituent fibers are polyester fibers.

29. The invention according to claim 28, wherein at least a portion of said hydrophilic constituent fibers are rayon fibers.

30. The invention according to claim 12, wherein said blended mixture of hydrophobic and hydrophilic constituent fibers comprises about 40% or more hydrophobic constituent fibers.

31. The invention according to claim 30, wherein at least a portion of said hydrophobic constituent fibers are polyester fibers.

32. The invention according to claim 31, wherein at least a portion of said hydrophilic constituent fibers are rayon fibers.

33. The invention according to claim 20, wherein said blended mixture of hydrophobic and hydrophilic constituent fibers comprises about 40% or more hydrophobic constituent fibers.

34. The invention according to claim 33, wherein at least a portion of said hydrophobic constituent fibers are polyester fibers.

35. The invention according to claim 34, wherein at least a portion of said hydrophilic constituent fibers are rayon fibers.

36. The invention according to claim 1, wherein said blended mixture of hydrophobic and hydrophilic constituent fibers comprises about 50% or more hydrophobic constituent fibers.

37. The invention according to claim 36, wherein at least a portion of said hydrophobic constituent fibers are polyester fibers.

38. The invention according to claim 20, wherein said blended mixture of hydrophobic and hydrophilic constituent fibers comprises about 50% or more hydrophobic constituent fibers.

39. The invention according to claim 38, wherein at least a portion of said hydrophobic constituent fibers are polyester fibers.

40. The invention according to claim 1, wherein said blended mixture of hydrophobic and hydrophilic constituent fibers comprises about 60% or more hydrophobic constituent fibers.

41. The invention according to claim 40, wherein at least a portion of said hydrophobic constituent fibers are polyester fibers.

42. The invention according to claim 20, wherein said blended mixture of hydrophobic and hydrophilic constituent fibers comprises about 60% or more hydrophobic constituent fibers.

43. The invention according to claim 42, wherein at least a portion of said hydrophobic constituent fibers are polyester fibers.

44. The invention according to claim 1, wherein said blended mixture of hydrophobic and hydrophilic constituent fibers comprises about 80% polyester fiber.

45. The invention according to claim 20, wherein said blended mixture of hydrophobic and hydrophilic constituent fibers comprises about 80% polyester fiber.

46. A launderable fluid containment textile composite of stitch bonded construction useful in absorbing fluid discharged by a user, the textile composite comprising:

a fluid retention layer of non-woven batting; and a plurality of bonding yarns extending in a repeating stitch bonding pattern through said fluid retention layer at an as stitched stitch density in the machine direction in the range of about 4 to about 12 stitches per inch wherein segments of said bonding yarns extending outwardly from said fluid retention layer define a substantially nonabrasive covering surface for contact by the user, and wherein said fluid retention layer comprises a blended mixture of hydrophobic and hydrophilic constituent fibers, and wherein said blended mixture comprises about 40% or more hydrophobic constituent fibers in blended relation with a percentage of hydrophilic constituent fibers.

47. The invention according to claim 46, wherein said blended mixture comprises about 50% or more hydrophobic constituent fibers in blended relation with a percentage of hydrophilic constituent fibers.

* * * * *